US011778356B2

(12) United States Patent
Hariba

(10) Patent No.: US 11,778,356 B2
(45) Date of Patent: Oct. 3, 2023

(54) SPEAKER UNIT AND IMAGE FORMING DEVICE

(71) Applicant: KYOCERA Document Solutions Inc., Osaka (JP)

(72) Inventor: Yoshihito Hariba, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/411,160

(22) Filed: Aug. 25, 2021

(65) Prior Publication Data

US 2022/0070562 A1 Mar. 3, 2022

(30) Foreign Application Priority Data

Aug. 28, 2020 (JP) ..... 2020-144538

(51) Int. Cl.
*H04R 1/02* (2006.01)
*G03G 21/16* (2006.01)

(52) U.S. Cl.
CPC ..... *H04R 1/026* (2013.01); *G03G 21/1604* (2013.01); *H04R 1/025* (2013.01)

(58) Field of Classification Search
CPC ..... H04R 1/026; H04R 1/025; G03G 21/1604
See application file for complete search history.

(56) References Cited

U.S. PATENT DOCUMENTS 3,719,250 A * 3/1973 Maekawa ..... H04R 1/02 181/153
4,152,256 A * 5/1979 Wennberg ..... B07B 1/4609 24/551
8,254,622 B2 * 8/2012 Jiang ..... G11B 33/025 381/387
2019/0049170 A1 * 2/2019 Reuter ..... F25D 11/02

FOREIGN PATENT DOCUMENTS

JP 2018-037826 3/2018

OTHER PUBLICATIONS

Translation of JP 2018-37826 A; Masakazu; Aug. 3, 2018.*

* cited by examiner

*Primary Examiner* — Andrew L Sniezek
(74) *Attorney, Agent, or Firm* — LEX IP MEISTER, PLLC

(57) ABSTRACT

A speaker unit is provided with a speaker attached to an opening of a unit housing, a wire spring extending from one side of the opening to the other side and holding the speaker, a first support section for supporting one side of the wire spring in the unit housing, and a second support section for supporting the other side of the wire spring in the unit housing, and the wire spring is formed with a curved portion that is stretchable in the extending direction from one side to the other side.

7 Claims, 7 Drawing Sheets

SPEAKER UNIT AND IMAGE FORMING DEVICE

INCORPORATION BY REFERENCE

This application is based upon and claims the benefit of priority from the corresponding Japanese Patent Application No. 2020-144538 filed on Aug. 28, 2020, the entire contents of which are incorporated herein by reference.

BACKGROUND

The present disclosure relates to a speaker unit and an image forming device.

A speaker unit is attached inside the housing of an image forming apparatus and various electronic devices. As such a speaker unit, there is known a structure in which a speaker is held in a unit housing by a wire spring. In the speaker unit, the surface of the speaker is exposed to the outside through an opening of the unit housing, and a wire spring for supporting the rear surface of the speaker is provided inside the unit housing. The elastic force of the wire spring presses the outer peripheral edge of the speaker against the opening edge of the unit housing, thereby holding the speaker inside the speaker unit.

A speaker unit according to an aspect of the present disclosure is provided with a speaker attached to an opening of a unit housing, a wire spring extending from one side of the opening to the other side and holding the speaker, a first support section for supporting one side of the wire spring in the unit housing, and a second support section for supporting the other side of the wire spring in the unit housing, wherein the wire spring is formed with a curved portion stretchable in the extending direction from one side to the other side.

An image forming device according to an aspect of the present disclosure includes the speaker unit and an image forming unit that forms an image on a sheet.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
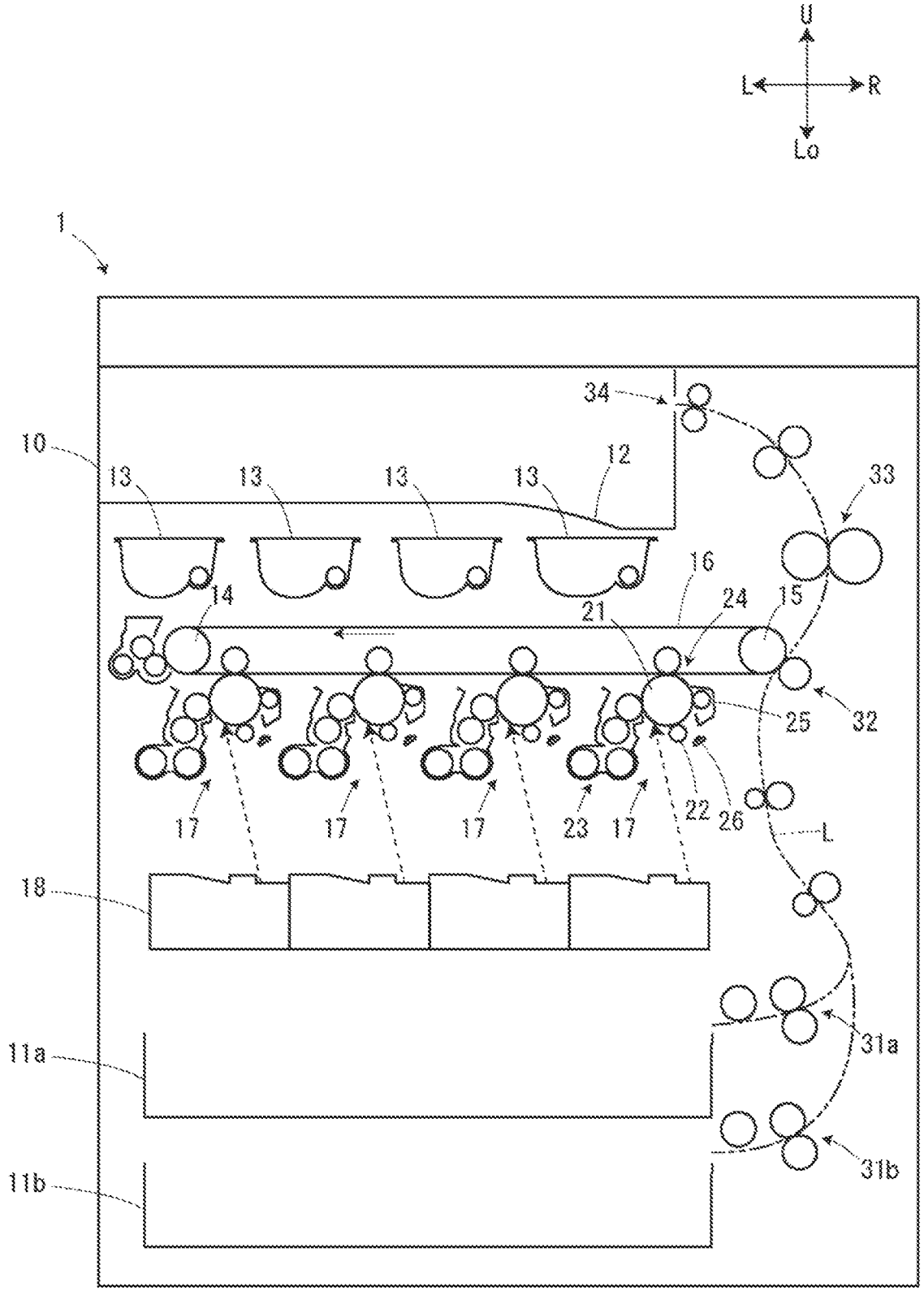
FIG. 1 is a schematic view of a printer according to an embodiment of the present invention.
Figure 2:
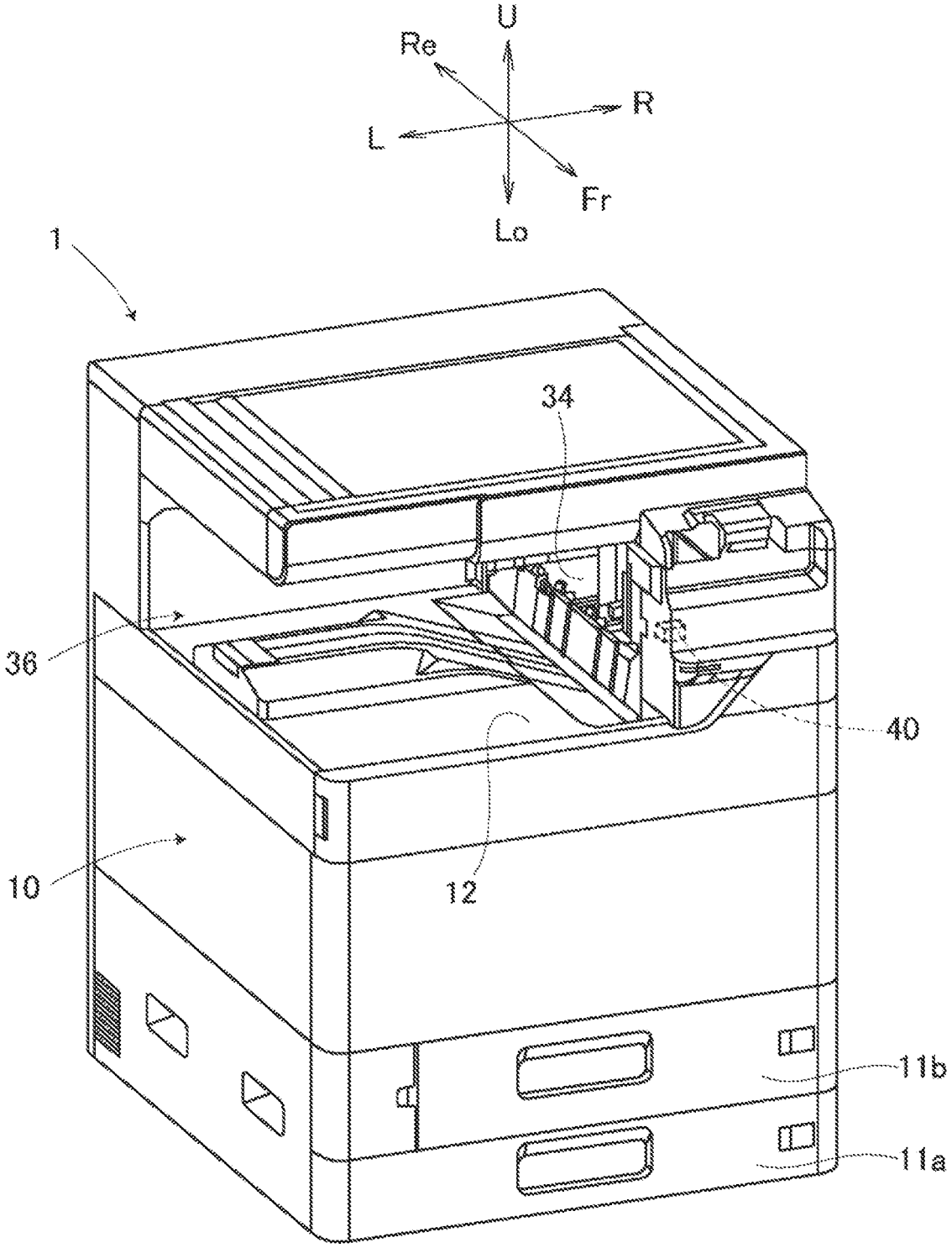
FIG. 2 is an external perspective view of the printer according to the present embodiment.

In the following description, an image forming device to which a display device of this embodiment is applied will be described below with reference to the drawings. In the following description, a printer will be exemplified as the image forming device. FIG. 1 is a schematic diagram of a printer according to the present embodiment. FIG. 2 is an external perspective view of the printer according to this embodiment. Arrows Fr, Re, U, Lo, L, and R, which are appropriately attached to the respective drawings, respectively indicate the front side, the rear side, the upper side, the lower side, the left side, and the right side of the printer.

As shown in FIG. 1, a printer 1 includes a box-shaped housing 10 in which various devices are housed. Paper feed cassettes 11*a* and 11*b* on which sheet bundles are set are housed in a lower portion of the housing 10, and a paper discharge tray 12 on which image-formed sheets are stacked is provided in an upper portion of the housing 10. A toner container 13 in which toner is stored is detachably set below the paper discharge tray 12 for each color of toner (for example, four colors of magenta, cyan, yellow, and black). An intermediate transfer belt 16 is provided below the plurality of toner containers 13, and is stretched over a pair of right and left rollers 14 and 15.

Along the lower side of the intermediate transfer belt 16, image forming sections 17 are provided in the left and right rows for each color of toner. To each of the image forming sections 17, a photosensitive drum 21 which rolls in contact with the intermediate transfer belt 16 is rotatably provided, and a charging device 22, a developing device 23, a primary transfer section 24, a cleaning device 25, and a discharge device 26 are arranged around the photosensitive drum 21 in the order in the primary transfer process. A waste toner box (not shown) is connected to the cleaning device 25. Toner is supplied from the toner container 13 through a supply path (not shown) to each developing device 23, and waste toner is discharged to the waste toner box from each cleaning device 25 through a discharge path (not shown).

Below each image forming section 17 is an exposure device 18 comprising a laser scanning unit (LSU). In a right side portion of the housing 10, a conveying path L for conveying sheets from the paper feed cassettes 11*a* and 11*b* to the paper discharge tray 12 is formed by a plurality of rollers. Paper feeding sections 31*a* and 31*b* are provided on the upstream side (lower side) of the conveying path L, and secondary transfer unit 32 is provided on the right end side of the intermediate transfer belt 16 on the downstream side of the paper feeding sections 31*a* and 31*b* in the conveying path L. A fixing device 33 is provided on the downstream side of the secondary transfer unit 32 in the conveying path L, and a paper discharge port 34 is provided on the downstream end side (upper side) of the conveying path L.

During image formation of the printer 1, after the surface of the photosensitive drum 21 is charged by the charging device 22, an electrostatic latent image is formed on the surface of the photosensitive drum 21 by laser light from the exposure device 18. Next, toner is deposited from the developing device 23 onto the electrostatic latent image on the surface of the photosensitive drum 21 to form a toner image, and the toner image is primarily transferred from the surface of the photosensitive drum 21 to the surface of the intermediate transfer belt 16. When the toner images of the respective colors are primarily transferred to the intermediate transfer belt 16 in the respective image forming sections 17, full-color toner images are formed on the surface of the intermediate transfer belt 16. The waste toner and charge remaining on the photosensitive drum 21 are removed by the cleaning device 25 and the discharge device 26.

On the other hand, sheets are taken in from the paper feed cassettes 11*a* and 11*b* or from a manual feed tray (not shown) by the paper feeding sections 31*a* and 31*b*, and the sheets are conveyed toward the secondary transfer unit 32 in synchronization with the above-described image forming operation. In the secondary transfer unit 32, the full-color toner image is secondarily transferred from the surface of the intermediate transfer belt 16 to the surface of the sheet, and the transferred sheet is conveyed toward the fixing device 33 downstream of the secondary transfer unit 32. In the fixing device 33, the toner image is fixed on the sheet, and the fixed sheet is discharged from the paper discharge port 34 onto the paper discharge tray 12. As the toner image transferred onto the sheet passes through the fixing device 33 in this manner, an image is formed on the surface of the sheet.

As shown in FIG. 2, the housing 10 of the printer 1 is formed with a trunk space 36, and the housing 10 is provided with a speaker unit 40 adjacent to the trunk space 36. The speaker sound output from the speaker unit 40 echoes in the trunk space 36, making it easier for the user to hear the speaker sound. On the rear side of the speaker unit 40 of the housing 10, the paper discharge port 34 is opened toward the trunk space 36. Since the speaker unit 40 and the paper discharge port 34 are separated in the front-rear direction, the speaker sound is not blocked by the sheet discharged from the paper discharge port 34.

Figure 3:
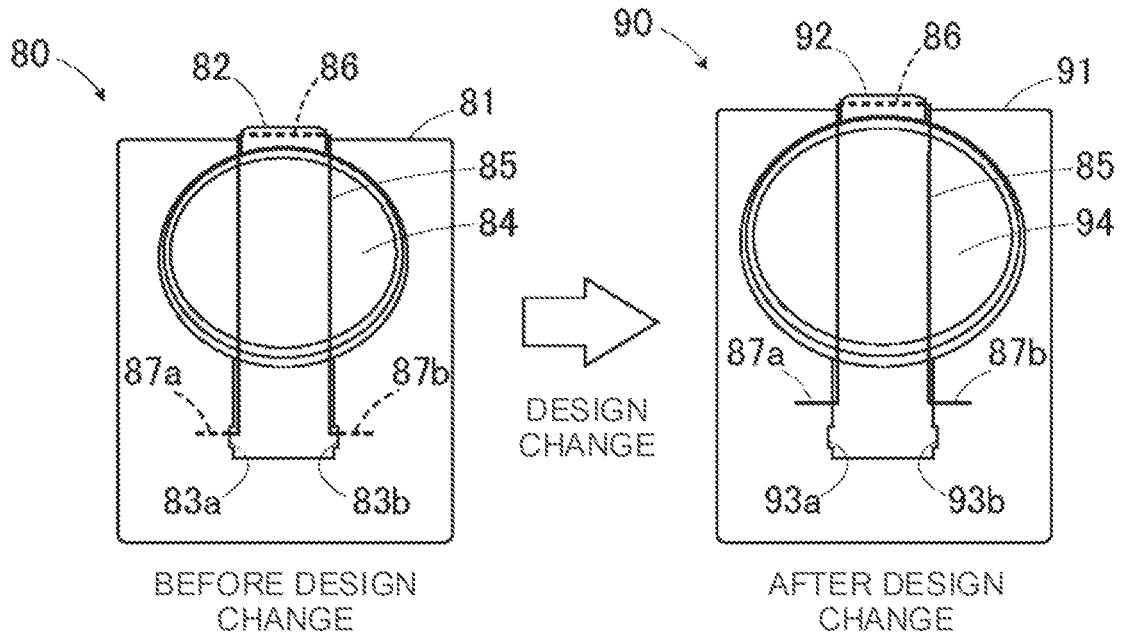
FIG. 3 is a diagram showing a state in which a wire spring is attached to a speaker unit of a comparative example.

As shown in FIG. 3, in a speaker unit 80 of the comparative example, a speaker 84 is held in a unit housing 81 via a wire spring 85. The wire spring 85 of the comparative example has a folded portion 86 hooked and fixed to a hook 82 of the unit housing 81, and L-shaped end portions 87*a* and 87*b* inserted into a slits 83*a* and 83*b* of the unit housing 81. The wire spring 85 is formed straight between the folded portion 86 and the end portions 87*a* and 87*b*. When a design change occurs in the speaker unit 80, the size of the wire spring 85 needs to be changed in accordance with the design change.

For example, a speaker unit 90 after the design change has a longer attachment distance from a hook 92 of a unit housing 91 to slits 93*a* and 93*b*. Therefore, the existing wire spring 85 cannot reach the slits 93*a* and 93*b* from the hook 92, and the end portions 87*a* and 87*b* of the wire spring 85 cannot be inserted into the slits 93*a* and 93*b*. If a wire spring is prepared for the speaker unit 90 after the design change, the appearance of the wire spring does not greatly change between before and after the size change, and therefore, there is a problem that the wire spring of different size is not noticed until the speaker unit 90 is assembled.

Figure 4:
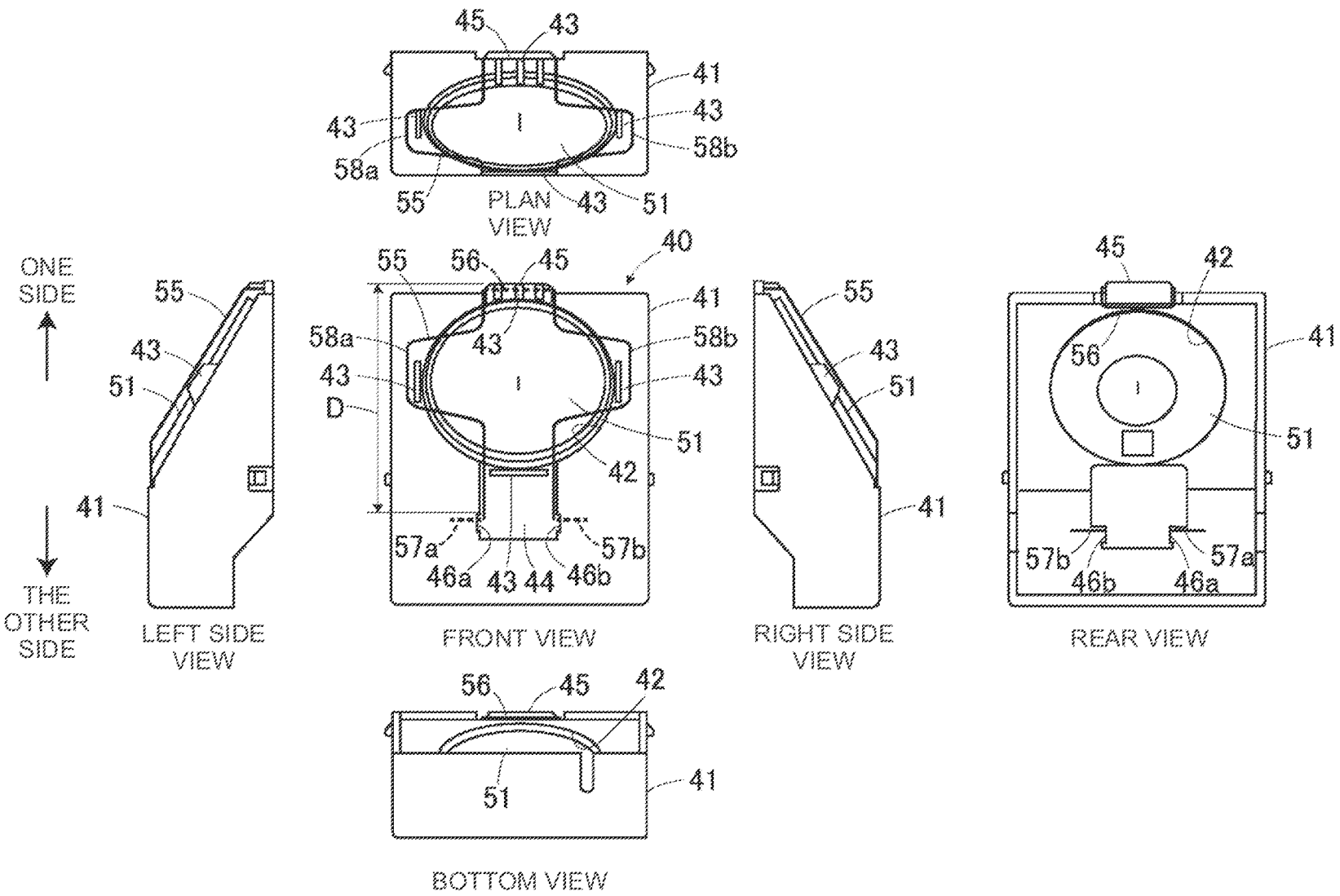
FIG. 4 is a six side view of a speaker unit of the present embodiment.

Therefore, the speaker unit 40 of the present embodiment holds a speaker 51 with respect to a unit housing 41 by using a wire spring 55 which can expand and contract in response to a design change of the speaker unit 40 (see FIG. 4). As a result, it is not necessary to wire spring 55 of different sizes, and one kind of wire spring 55 can flexibly cope with design changes of the speaker unit 40. Further, when the speaker unit 40 is assembled, the problem of using the wire springs 55 of different sizes does not occur. The design of the speaker unit 40 can be easily changed without considering the length of the wire spring 55.

Figure 5:
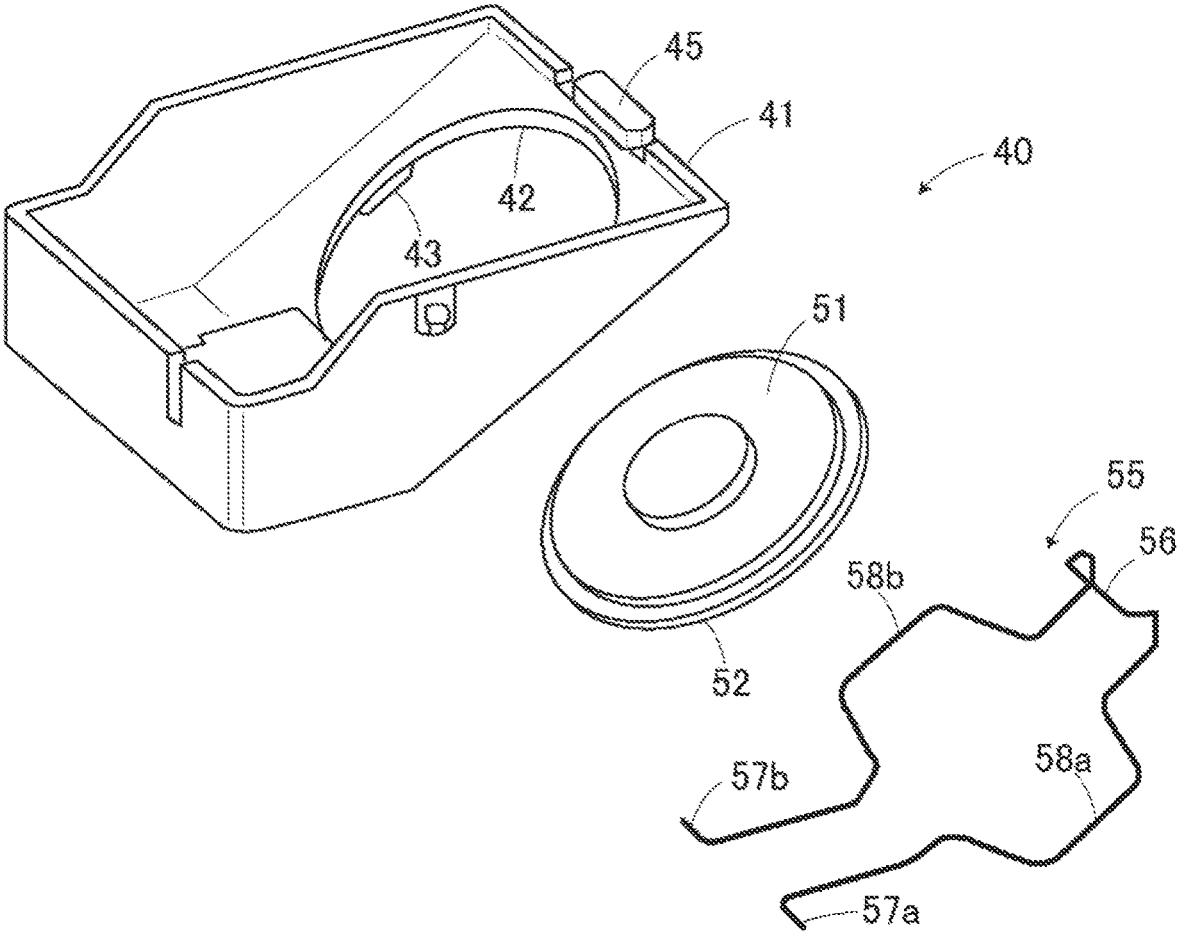
FIG. 5 is an exploded perspective view of a speaker unit of the present embodiment.

Referring to FIGS. 4 and 5, a speaker unit will be described. FIG. 4 is a six side view of a speaker unit of the present embodiment. FIG. 5 is an exploded perspective view of the speaker unit of the present embodiment.

As shown in FIG. 4, in the speaker unit 40, the speaker 51 is attached to an opening 42 of the unit housing 41, and the speaker 51 is held in the unit housing 41 by the wire spring 55. The speaker 51 is connected to a control unit of the printer 1 (see FIG. 1), and information relating to image formation is outputted from the speaker 51 as speaker sound. The speaker 51 is a disc type speaker, and the front side of the speaker 51 is formed to have a larger diameter than the rear side thereof. The front side of the speaker 51 extends radially outward from the rear side. As a result, a flange portion 52 (see FIG. 5) is formed on the outer edge of the speaker 51.

The unit housing 41 is formed in a box shape having a substantially trapezoidal shape in a side view with the rear surface thereof opened. The circular opening 42 is formed in the sloped wall at the front of the unit housing 41 for attaching the speaker 51. The flange portion 52 (see FIG. 5) of the speaker 51 abuts against the opening edge of the unit housing 41, and the rear side of the speaker 51 enters the opening 42 of the unit housing 41. Positioning pieces 43 project outward from four positions around the opening 42, and the speakers 51 are positioned by the four positioning pieces 43. On the front surface of the unit housing 41, a concave portion 44 is formed to have a rectangular shape in front view in which the front side is recessed and the rear side is expanded.

The unit housing 41 is provided with the wire spring 55 which extends from one side of the opening 42 to the other side and presses the speaker 51. The wire spring 55 is formed by bending one wire rod, a folded portion 56 is formed on one side of the wire spring 55, and both end portions 57*a* and 57*b* bent in an L-shape are formed on the other side of the wire spring 55. A pair of curved portions 58*a* and 58*b* are formed between the folded portion 56 and the one end portion 57*a* and between the folded portion 56 and the other end portion 57*b* so as to be stretchable in the extending direction from one side to the other side, respectively. The pair of curved portions 58*a* and 58*b* are curved in a U-shape, and the curved portions 58*a* and 58*b* are easily bent in the stretching direction.

The folded portion 56 on one side of the wire spring 55 is hooked to the hook 45 of the unit housing 41, and both end portions 57*a* and 57*b* on the other side of the wire spring 55 are inserted into a pair of slits 46*a* and 46*b* in the concave portion 44 of the unit housing 41. When the L-shaped both end portions 57*a*, 57*b* of the wire spring 55 enter the pair of slits 46*a*, 46*b*, the other side of the wire spring 55 is prevented from coming out by the pair of slits 46*a*, 46*b*. The hook 45 functions as a first support for supporting one side of the wire spring 55 in the unit housing 41, and the pair of slits 46*a* and 46*b* function as a second support for supporting the other side of the wire spring 55 in the unit housing 41.

Since the pair of curved portions 58*a* and 58*b* of the wire spring 55 are formed in a U-shape, the length from the folded portion 56 to both end portions 57*a* and 57*b* is expanded and contracted by the bending deformation of the curved portions 58*a* and 58*b*. Therefore, even if the attachment distance D of the wire spring 55 from the hook 45 to the pair of slits 46*a* and 46*b* is increased by several mm due to a design change or the like of the unit housing 41, the wire spring 55 of the same size can be used. Further, since the speaker 51 is pressed in a wide range by the curved portions 58*a* and 58*b*, the vibration of the speaker 51 when the speaker sound is outputted is suppressed, so that the user can easily hear the speaker sound.

As shown in FIG. 5, when the speaker unit 40 is assembled, the speaker 51 is attached from the front side of the unit housing 41. The rear side of the speaker 51 enters the opening 42 of the unit housing 41, and the flange portion 52 of the speaker 51 is pressed against the opening edge. The folded portion 56 of the wire spring 55 is hooked to the hook 45 of the unit housing 41, and the speaker 51 is pressed against the unit housing 41 by the elastic force of the wire spring 55. In this state, both end portions 57*a* and 57*b* of the wire spring 55 are inserted into the slits 46*a* and 46*b* (see FIG. 4), and the speaker 51 is held in the unit housing 41 via the wire spring 55.

Although both end portions 57*a* and 57*b* of the wire spring 55 are bent in an L-shape, the wire spring 55 bends so as to bring both end portions 57*a* and 57*b* close to each other, so that the wire spring 55 can be inserted into the slits 46*a* and 46*b*. As described above, even if the attachment distance D (see FIG. 4) of the wire spring 55 from the hook 45 of the unit housing 41 to the pair of slits 46*a* and 46*b* changes, the change in the attachment distance D of the wire spring 55 is absorbed by the bending of the pair of curved portions 58*a* and 58*b*. In this way, the speaker unit 40 can be assembled by a simple operation of attaching the speaker 51 to the unit housing 41 and pressing the speaker 51 from the front side by the wire spring 55.

Figure 6:
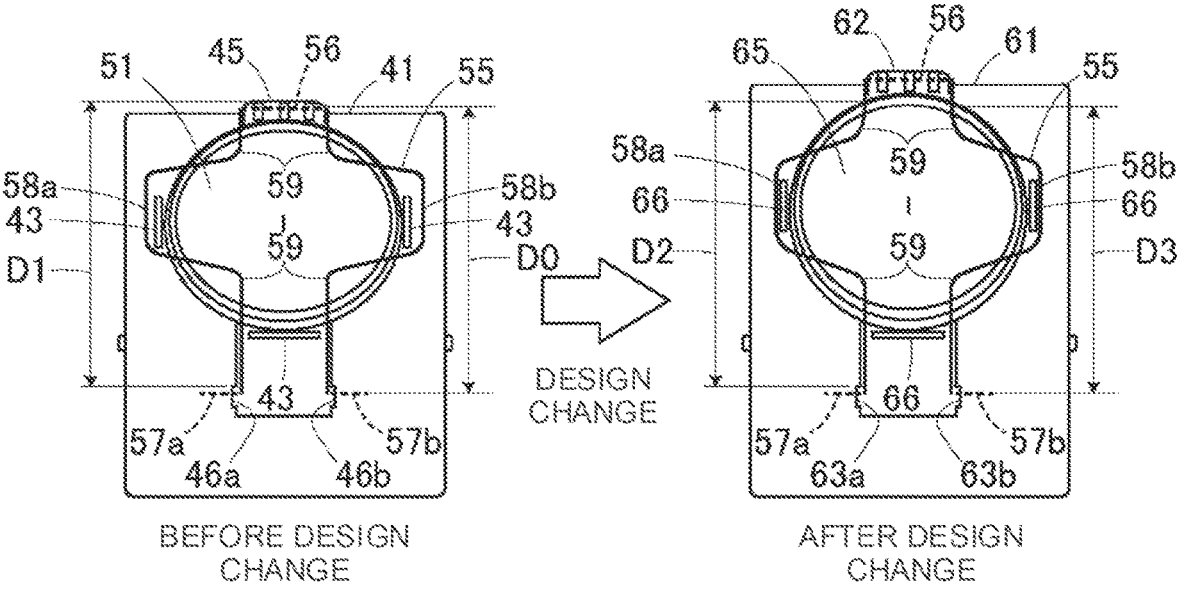
FIG. 6 is a view showing a state in which a wire spring is attached to a unit housing of the present embodiment.

The attachment of the wire spring will be described with reference to FIG. 6. FIG. 6 is a view showing a state in which the wire spring is attached to the unit housing of the present embodiment.

As shown in FIG. 6, in the unit housing 41 before the design change, the attachment distance from the hook 45 to the pair of slits 46*a* and 46*b* is formed at D1. An equilibrium length from the folded portion 56 of the wire spring 55 to both end portions 57*a* and 57*b* is formed at D0. The attachment distance D1 of the unit housing 41 and the equilibrium length D0 of the wire spring 55 substantially coincide with each other. That is, the wire spring 55 is formed to have a length corresponding to the unit housing 41 before the design change. Therefore, the wire spring 55 can be attached to the unit housing 41 by slightly bending the wire spring 55.

In the unit housing 61 after the design change, the attachment distance from the hook 62 to the pair of slits 63*a* and 63*b* is formed at D2. The attachment distance D2 of the unit housing 61 is formed to be several mm longer than the attachment distance D1 of the unit housing 41 before the design change. Normally, since the attachment distance D2 of the unit housing 61 is longer than the wire spring 55, a wire spring having a length corresponding to the attachment distance D2 of the unit housing 61 is required. However, in the present embodiment, the overall length D3 of the wire spring 55 from the folded portion 56 to the both end portions 57*a* and 57*b* extends, and the wire spring 55 is attached to the unit housing 61.

More specifically, the U-shaped curved portions 55*a* and 58*b* of the wire spring 58 are bent so as to expand. As a result, the overall length D3 from the folded portion 56 to the both end portions 57*a* and 57*b* is extended. Since the overall length of the wire spring 55 is extended by the bending deformation of the curved portions 58*a* and 58*b*, changes in the attachment distances D1 and D2 due to design changes of the unit housing 41, 61 are absorbed. At this time, the positioning pieces 43, 66 are positioned inside the curved portions 58*a* and 58*b*, but the positional relationship between the curved portions 58*a* and 58*b* and the positioning pieces 43 and 66 is adjusted so that the bending deformation of the curved portions 58*a* and 58*b* is not inhibited by the positioning pieces 43 and 66.

A bent portion 59 is formed at the base end side of curved portion 58*a* and 58*b* of the wire spring 55, and the outer peripheral side of the speaker 51, 65 is pressed by these four bent portions 59. The rigidity of the wire spring 55 is increased at the bent portion 59, and the bent portion 59 is less likely to be bent even when a reaction force is received from the speaker 51, 65. Therefore, the speakers 51 and 65 can be pressed against the unit housing 41 in a balanced manner while reducing the contact area between the wire spring 55 and the speaker 51, 65 by the four bent portions 59 of the wire spring 55. Further, vibrations of the speakers 51, 65 are further suppressed, making it easier for the user to hear speaker sounds.

As described above, according to the present embodiment, the curved portions 58*a* and 58*b* of the wire spring 55 expand and contract in the extending direction to adjust the overall length from one side to the other end side of the wire spring 55. Even when a design change occurs in the speaker unit 40, one side and the other side of the wire spring 55 are appropriately supported by the hook 45 and the slits 46*a* and 46*b* of the unit housing 41. It is not necessary to prepare the wire spring 55 of a new size in accordance with a design change of the speaker unit 40, and handling error of a plurality of wire springs of different sizes do not occur. Therefore, the wire spring 55 can flexibly correspond to the design change of the speaker unit 40.

In addition, by installing the speaker unit 40 of the present embodiment in the printer 1, it is possible to easily change the design of the speaker unit 40 for notifying the surroundings of information related to image formation.

Figure 7A:
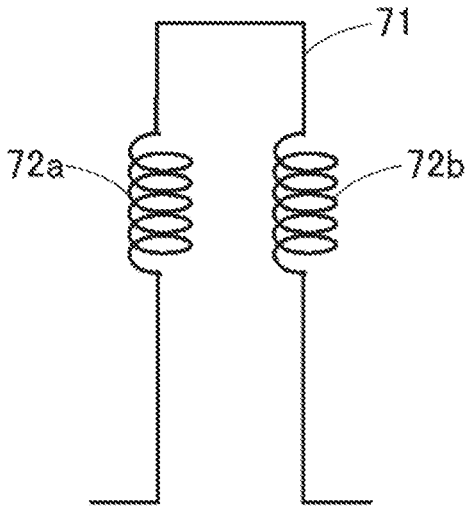
FIG. 7A is a schematic view of a wire spring according to a variation.
Figure 7B:
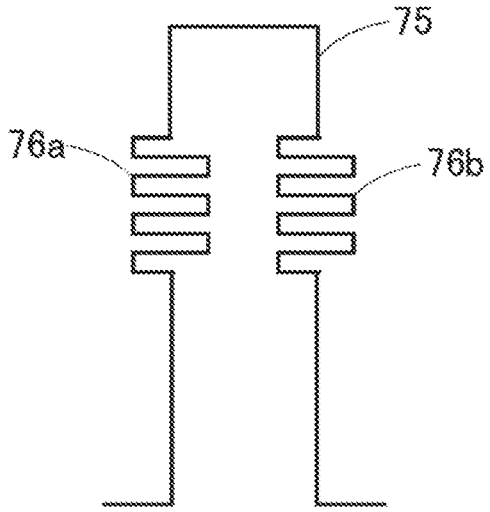
FIG. 7B is a schematic view of a wire spring according to another variation.

In the present embodiment, the wire spring 55 is curved in a U-shape to form curved portions 58*a* and 58*b*, but the shape of the curved portion is not particularly limited. The curved portion may be formed so as to be stretchable in the extending direction from one side to the other side of the wire spring. For example, as shown as a wire spring 71 of the modified example of FIG. 7A, curved portions 72*a* and 72*b* may be formed by bending the wire spring 71 into a coil shape. Further, as shown in a wire spring 75 of the modified example of FIG. 7B, curved portions 76*a* and 76*b* may be formed by bending the wire spring 75 into a bellows shape. In this case, the wire spring 71, 75 can be expanded and contracted in the extending direction by the expansion and contraction deformation of the coil-shaped curved portions 72*a* and 72*b* and the expansion and contraction deformation of the bellows-shaped curved portions 76*a* and 76*b*.

Further, in the present embodiment, the wire spring 55 is formed by one wire rod, but the wire spring may be formed by a plurality of wire rods.

Further, in the present embodiment, the speaker 51 is attached to the unit housing 41 from the front side, but the speaker may be attached to the unit housing from the rear side. In this case, the rear side of the speaker is supported by the wire spring.

Further, in the present embodiment, the hook 45 for hooking the folded portion 56 of the wire spring 55 is exemplified as the first support portion, but the first support portion may be formed so as to support one side of the wire spring in the unit housing.

Further, in this embodiment, the slits 46*a* and 46*b* into which both end portions 57*a* and 57*b* of the wire spring 55 are inserted are exemplified as the second support portion, but the second support portion may be formed so as to support the other side of the wire spring in the unit housing.

Further, in the present embodiment, the speaker unit 40 is applied to the image forming apparatus, but the speaker unit 40 can be applied to other electronic devices.

Further, in the present embodiment, the sheet may be a sheet-like sheet for forming an image, and may be, for example, a plain paper, a coated paper, or a tracing paper, OHP (Over Head Projector) sheet.

Although the present embodiment has been described, other embodiments may be a combination of all or part of the above-described embodiments and modifications.

Further, the technology of the present disclosure is not limited to the above embodiment, and may be variously changed, substituted or modified without departing from the spirit of the technical idea. Further, if the technical idea can be realized in another way by the progress of the technology or another derived technology, the invention may be implemented using the method. Accordingly, the claims cover all embodiments that may be included within the scope of the technical idea.

The invention claimed is:

1. A speaker unit comprising:

a speaker attached to an opening of a unit housing;

a wire spring extending from one side of the opening to the other side and holding the speaker;

a first support portion for supporting the one side of the wire spring in the unit housing; and a second support portion for supporting the other side of the wire spring in the unit housing;

wherein the wire spring is formed with a pair of curved portions provided between the one side and the other side such that the speaker is placed between the pair of the curved portions to be held by the wire spring, the pair of curved portions being stretchable in an extending direction from the one side to the other side such that a distance between the one side and the other side changes according to speakers that have different speaker design shapes being placed between the pair of curved portions.

2. The speaker unit according to claim 1, wherein the pair of curved portions are curved in a U-shape.

3. The speaker unit according to claim 1, wherein the pair of curved portions are curved in a coil shape.

4. The speaker unit according to claim 1, wherein the wire spring is formed by bending one wire rod, wherein a folded portion is formed on the one side of the wire spring, and L-shaped both end portions are formed on the other side of the wire spring, wherein the first support portion is a hook for latching the folded portion of the wire spring, and wherein the second support portion is a pair of slits into which the both end portions of the wire spring are inserted.

5. An image forming apparatus comprising:

the speaker unit according to claim 1, and an image forming unit for forming an image on a sheet.

6. The speaker unit according to claim 1, wherein the unit housing includes a positioning piece to position the speaker that is placed between the pair of the curved portions, the positioning piece being positioned inside the pair of curved portions such that bending deformation of the pair of curved portions is not inhibited by the positioning piece.

7. A speaker unit comprising:

a speaker attached to an opening of a unit housing;

a wire spring extending from one side of the opening to the other side and holding the speaker;

a first support portion for supporting the one side of the wire spring in the unit housing; and a second support portion for supporting the other side of the wire spring in the unit housing;

wherein the wire spring includes two side portions with one side portion on opposite sides of the speaker such that the speaker which is placed between the two side portions is held by the wire spring, the two side portions being stretchable such that a distance between the one side and the other side changes according to a plurality of speakers having different speaker design shapes that are placed between the two side portions.

* * * * *